United States Patent [19]

Bruening

[11] 4,243,151

[45] Jan. 6, 1981

[54] FLOATING ROOF PENETRATIONS WITH REDUCED VAPOR SPACE SEAL

[76] Inventor: Robert A. Bruening, 1541 Chippewa Dr., Naperville, Ill. 60540

[21] Appl. No.: 54,172

[22] Filed: Jul. 2, 1979

[51] Int. Cl.[3] ..... B65D 87/18

[52] U.S. Cl. ..... 220/216; 220/221

[58] Field of Search ..... 220/216, 221, 222, 226, 220/225, 227; 224/216, 219, 222, 224, 226

[56] References Cited

U.S. PATENT DOCUMENTS

| | | | |
|---|---|---|---|
| 1,650,340 | 11/1927 | Glass | 220/221 |
| 1,674,038 | 6/1928 | Glass | 220/221 |
| 3,307,733 | 3/1967 | DeBock | 220/226 |
| 3,366,266 | 1/1968 | Heartstedt | 220/216 |
| 3,375,951 | 4/1968 | Donald | 220/222 |
| 3,493,143 | 2/1970 | Thompson et al. | 220/222 X |
| 3,583,594 | 6/1971 | Belanger et al. | 220/222 X |
| 4,014,454 | 3/1977 | Nayler et al. | 220/226 X |
| 4,173,291 | 11/1979 | Hills | 220/222 X |

*Primary Examiner*—Steven M. Pollard

*Attorney, Agent, or Firm*—Merriam, Marshall & Bicknell

[57] ABSTRACT

An improvement in a storage tank for a liquid having a floating roof and at least one stationary vertical member penetrating the floating roof through a well defined by an opening therein surrounded by a well wall partially in and partially above the level of a liquid stored in the tank, with the improvement being a vapor seal, covering the area between the vertical member and the well wall, positioned about at but above the liquid level in the well to thereby reduce the space in which vapor from the liquid can first accumulate and then be dispersed with vertical movement of the floating roof.

1 Claim, 8 Drawing Figures

FLOATING ROOF PENETRATIONS WITH REDUCED VAPOR SPACE SEAL

This invention relates to floating roof storage tanks for liquids. More particularly, this invention is concerned with improved apparatus for sealing the openings or wells through which penetrating members extend to prevent vapor loss and thereby cause air pollution.

A wide variety of liquid materials are stored in cylindrical, usually flat-bottomed storage tanks containing a floating roof which covers the liquid and rides up and down on the liquid surface with liquid volume change in the tank. The storage tank can have, in addition to the floating roof, a fixed exterior roof, usually conical or domed, when the tank is located where snow, ice and rain are problems or for other reasons. Each type of tank will have at least one internal vertical stationary member which penetrates the floating roof through a loosely fitting sleeve or well wall. The vertical member can be a guide pole which prevents rotation of the floating roof about a vertical axis, a support column for an outer roof when present, a ladder, or a combination of such vertical members.

The sleeve or well wall around the hole or opening in the floating roof must be substantially larger than the vertical member which penetrates or extends through it so as to permit lateral movement of the roof, which occurs when the floating roof is vertically displaced, due to unavoidable out of roundness of the tank and floating roof. Unless there is enough clearance for unrestrained movement of the floating roof relative to the vertical member, the roof could become locked in position and be held above a lowering liquid level or below a rising liquid level with subsequent damage to the roof, exposure of liquid and loss of vapor.

The holes or openings in a floating roof are surrounded by a sleeve or well wall which projects beneath the liquid level and to a height above the liquid level which is clearly sufficient to prevent the liquid from spilling over onto the floating roof top. The result is the creation of a vapor space inside of the well formed by the sleeve or well wall above the liquid level in the well. Even though a laterally movable plate type seal is generally placed on top of the well wall, vapor which accumulates in the well escapes when the roof is displaced. This is undesirable since the escaping vapor can cause pollution. A need accordingly exists for apparatus which reduces the loss of vapor from the well of a floating roof through which a penetrating vertical member extends.

According to the invention, there is provided an improvement in a storage tank for a liquid having a floating roof and at least one stationary vertical member penetrating the floating roof through a well defined by an opening therein surrounded by a well wall partially in and partially above the level of a liquid stored in the tank, with the improvement comprising a vapor seal means, covering the area between the vertical member and the well wall, positioned about at but above the liquid level in the well to thereby reduce the space in which vapor from the liquid can first accumulate and then be dispersed with vertical movement of the floating roof.

The invention will be described further in conjunction with the attached drawings, in which.

Similar elements or parts which appear in the various views of the drawings will be identified by the same numbers.

Figure 1:
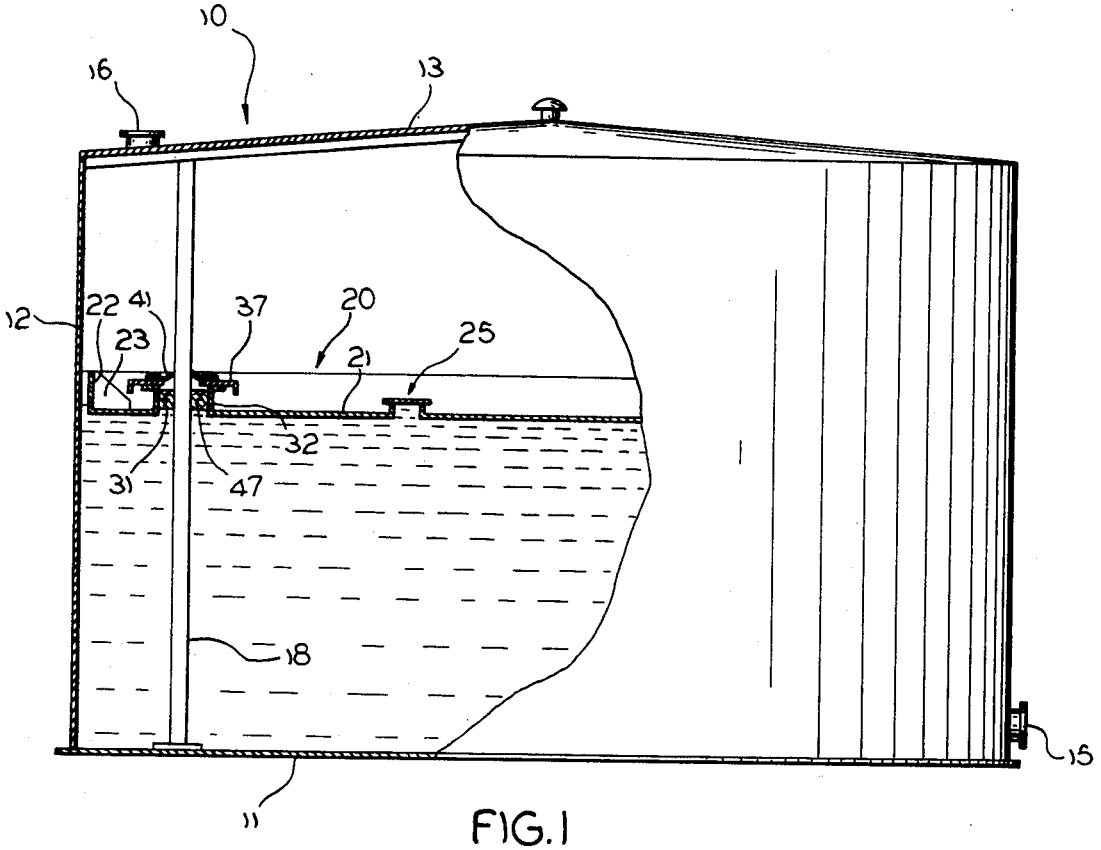
FIG. 1 is an elevational view, partially broken away and in section, showing a floating roof tank with an outer roof.

With reference to FIG. 1, the tank 10 has a flat metal bottom 11, vertical cylindrical metal wall 12 and conical outer roof 13. Manhole 15 is located in wall 12 and manhole 16 is located in outer roof 13. Eccentrically located vertical pipe column 18 extends from tank bottom 11 to outer roof 13 and aids in supporting the outer roof.

Inside of tank 10 is floating roof 20 which has a metal deck 21 and vertical peripheral flange 22 reinforced by braces 23. Manhole 25 is located in deck 21.

Figure 3:
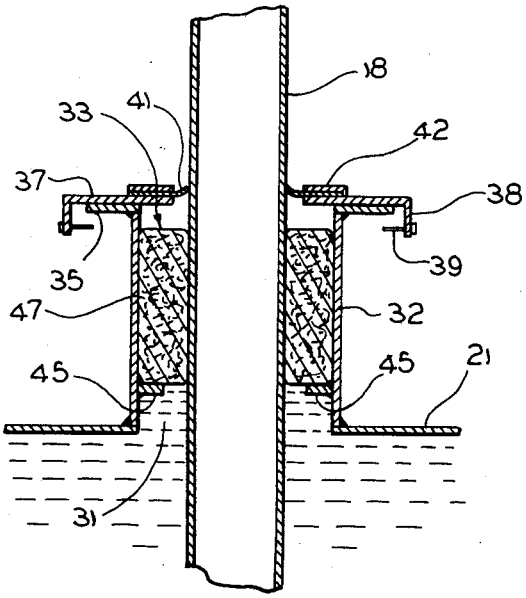
FIG. 3 is an enlarged view of the seal shown in FIG. 1.

Column 18 penetrates through opening 31 in floating roof 20. Opening 31 is surrounded by a vertical sleeve or well wall 32, as shown in FIGS. 1 and 3, which defines well 33. As shown in FIG. 3, extending outwardly from the top of well wall 32 is horizontally positioned ring plate 35 which provides a surface on which seal ring plate 37 can laterally slide. Downwardly depending peripheral flange 38, on plate 37, limits lateral movement of seal ring plate 37 and upward displacement of this plate off of plate 35 is limited by horizontally positioned bolts 39 in flange 38. Positioned on top of seal ring plate 37 is flexible membrane 41 which contacts the surface of pipe column 18. Membrane 41 is held in place by plate 42. The so-far described slidable seal comprising plate 37 and membrane 41 are conventional and have been used for years prior to the subject invention.

Projecting inwardly from the lower part of wall 32 are support stubs 45 located just below or about at the liquid level in the well 33. Most or essentially all of the well 33 is occupied by a seal means, which in FIGS. 1 and 3 is shown to be of flexible polymeric foam. The particular flexible polymeric foam member shown in those figures is annulus shaped and, desirably, is covered with a liquid-resistant flexible sheeting material. A suitable material for the seal, which may be molded to the desired size and shape, is polyurethane foam. Regardless of the type of foamed material used, the seal is made large enough to eliminate space in the well where vapor could otherwise accumulate and then escape past membrane 41. In this regard, membrane 41 and plate 37 are not considered necessary when the foam seal, or any other seal provided by the invention, is used.

Figure 2A:
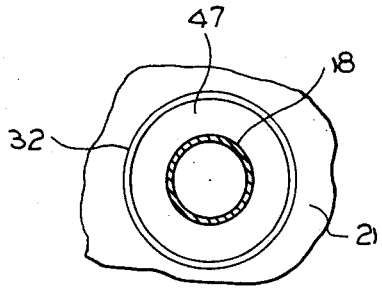
FIG. 2A is a plan view partially in section of a floating roof well penetrated by a pipe column.

FIGS. 2A to 2D illustrate the type of columns or related vertical members which presently penetrate floating roofs through well openings. FIG. 2A shows the seal 47 already described in conjunction with FIGS. 1 and 3.

Figure 2B:
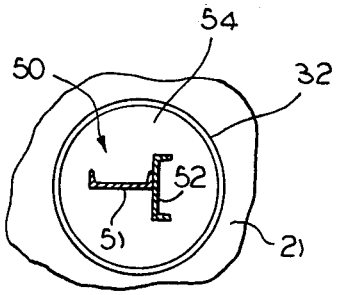
FIG. 2B is a plan view partially in section of a floating roof well penetrated by a Tee-column made from two channel members.

FIG. 2B illustrates a vertical member, or column 50, formed by welding two channel members 51 and 52 into a Tee shape. The space in the well can be sealingly filled by a polymeric foam member 54 molded to fit around the column 50 in the same manner as seal 47 fits around pipe column 18.

Figure 2C:
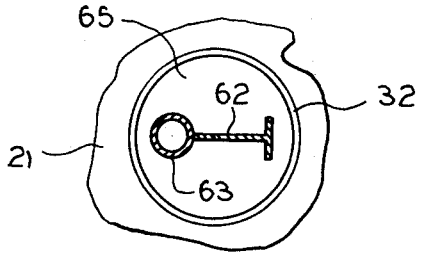
FIG. 2C is a plan view partially in section of a floating roof well penetrated by a pipe guide pole-ladder combination.

The vertical member 60, shown in FIG. 2C, is a combination guide pole 61 and ladder 62 and it extends through the opening defined by well wall 32. A polymeric foam member 65 is placed in the well to occupy the space therein to avoid vapor accumulation.

Figure 2D:
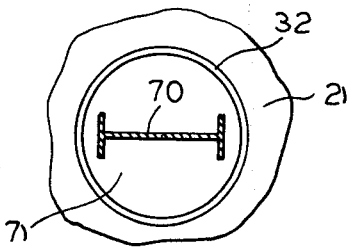
FIG. 2D is a plan view partially in section of a floating roof well penetrated by a ladder.

FIG. 2D shows vertical ladder 70 inside of well wall 32. The seal 71 of polyurethane foam, filling the well space, can be molded to the appropriate size and shape.

Figure 4:
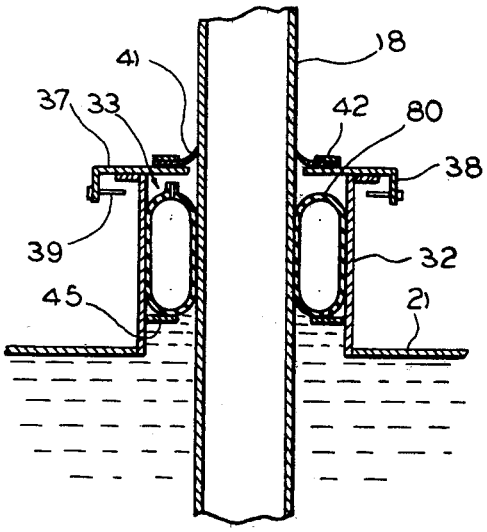
FIG. 4 is similar to FIG. 3 but shows a hollow seal member.

FIG. 4 illustrates an additional embodiment of the invention in which the well space 33 is essentially completely filled by a hollow flexible member containing a fluid, which can be a gas such as air or a liquid such as ethylene glycol. The hollow flexible member can be formed into the shape of an annulus, or other appropriate shape, to both occupy the well space and also make suitable contact with the vertical member 18.

Figure 5:
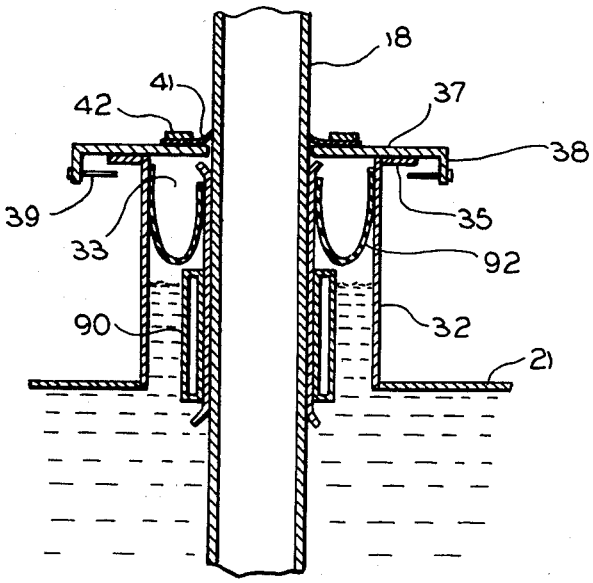
FIG. 5 is similar to FIG. 3 but shows a pontoon float from which a flexible membrane extends to the well wall.

The further embodiment of the invention illustrated by FIG. 5 has a pontoon float 90, in the form of an annulus, mounted to a cylindrical shoe 91 which slidably surrounds column 18. Flexible elastomeric seal 92, joined to the top of shoe 91 and the top of well wall 32 by any suitable means, projects radially outwardly and upwardly into sealing contact with the internal surface of well wall 32. The displacement of pontoon float 90 in the liquid on which the roof floats is designed so that the flexible elastomeric seal 92 is positioned above the liquid level so as to essentially eliminate a vapor accumulating space therebeneath.

The foregoing detailed description has been given for clearness of understanding only, and no unnecessary limitations should be understood therefrom as modifications will be obvious to those skilled in the art.

What is claimed is:

1. In a storage tank for a liquid having a floating roof and at least one stationary vertical member penetrating the floating roof through a well defined by an opening therein surrounded by a well wall partially in and partially above the level of a liquid stored in the tank, the improvement comprising:

a vapor seal means covering the area between the vertical member and well wall positioned about at but above the liquid level in the well to thereby reduce the space in which vapor from the liquid can first accumulate and then be dispersed with vertical movement of the floating roof, with said seal means comprising a vertically displaceable shoe surrounding the stationary vertical member and a flexible membrane extending from the shoe to the well wall.

* * * * *